United States Patent [19]

Jones

[11] Patent Number: 4,882,916

[45] Date of Patent: Nov. 28, 1989

[54] KNITTING MACHINE STOP MOTION ACTIVATOR

[76] Inventor: Robert E. Jones, Rte. 4, Box 509, Conover, N.C. 28613

[21] Appl. No.: 317,969

[22] Filed: Mar. 2, 1989

[51] Int. Cl.[4] ..... D04B 35/12

[52] U.S. Cl. ..... 66/163

[58] Field of Search ..... 66/157, 161, 163

[56] References Cited

U.S. PATENT DOCUMENTS 3,343,158 9/1967 Tellerman ..... 66/163

3,650,128 3/1972 Ferda et al. ..... 66/161 X

*Primary Examiner*—Ronald Feldbaum

*Attorney, Agent, or Firm*—Bell, Seltzer, Park & Gibson

[57] ABSTRACT

The stop motion activator includes a solenoid coil with an elongate armature core supported for axial movement within the solenoid coil. The armature core is movable inwardly to a first axial position within the solenoid coil when the solenoid coil is energized and is manually movable outwardly to a second axial position when the solenoid coil is deenergized. A control switch is operatively associated with the movement of the armature core and is in a closed position to permit energization of the solenoid coil when the armature core is in the second axial position and is moved to an open position as soon as the armature core is moved inwardly to the first axial position to immediately deenergize the coil after the core has moved inwardly. The armature core is operatively connected to the stop mechanism of the knitting machine to immediately stop the operation of the knitting machine when a malfunction is detected.

7 Claims, 1 Drawing Sheet

KNITTING MACHINE STOP MOTION ACTIVATOR

FIELD OF THE INVENTION

This invention relates generally to a knitting machine stop motion activator, and more particularly to such an activator which includes a solenoid that is normally maintained in a deactivated or nonenergized condition and is momentarily energized only when a malfunction of the knitting machine occurs.

BACKGROUND OF THE INVENTION

It is desirable that the operation of a knitting machine be immediately stopped when a malfunction occurs to prevent the production of waste knit fabric and/or to prevent damage to the parts of the knitting machine. The first types of stop motions employed on knitting machines were entirely mechanical. For example, U.S. Pat. No. 1,727,171 discloses one such entirely mechanical stop motion device in which a pivoted detector lever is positioned to be engaged by a needle with a broken butt traveling along a higher than normal path of travel. The detector lever is mechanically connected to the stop motion mechanism so that the operation of the knitting machine is stopped when the detector lever is engaged by a needle with a broken butt. It is extremely difficult to maintain this type of mechanical linkage in proper adjustment and to immediately stop the knitting machine when a malfunction occurs.

More recently it has been the practice to utilize electro-mechanical activator devices to stop the knitting machine upon the occurrence of various types of malfunctions, such as improperly positioned latches on the knitting needles, broken yarns, broken needle butts and the like. These electro-mechanical activator devices usually include an electrical detector switch which is positioned to be operated when a malfunction occurs. The detector switch operates an electrically operated solenoid connected to the knitting machine stop motion. These known types of solenoids are either of the type which remain energized until a malfunction occurs, or of the type which are energized when a malfunction occurs and remain energized until the malfunction is corrected. In either case, the solenoid uses unnecessary amounts of electrical energy and the useful life of the solenoid can be reduced by the extended time in which electrical energy is supplied thereto.

SUMMARY OF THE INVENTION

With the foregoing in mind, it is an object of the present invention to provide an improved activator for the stop motion of the knitting machine which includes a solenoid that is normally maintained in a deactive or nonenergized condition and is momentarily energized only when a malfunction of the knitting machine occurs so that the activator uses a very small amount of electrical energy and has a long wear life.

The activator of the present invention includes a solenoid coil with an elongated armature core supported for axial movement within the solenoid coil. The armature core is operatively connected to the usual stop motion device of the knitting machine and is manually movable to a second axial position with the solenoid coil deenergized. A malfunction detector switch is operable when a malfunction of the knitting machine occurs to supply electrical energy to the solenoid coil so that the armature core is immediately moved to a first axial position within the solenoid coil to immediately actuate the stop motion and stop operation of the knitting machine. An electrical control switch is operatively associated with the armature core and operates with movement of the armature core to the first axial position to immediately break the electrical circuit to the solenoid coil and prevent further flow of electrical energy to the solenoid coil. Thus, the solenoid coil of the activator is energized only momentarily when a malfunction occurs so that only a very small amount of electrical energy is consumed by the solenoid coil and the activator has a long wear life.

The electrical control switch includes a pair of electrical spring arms having inner ends in electrical contact with spaced-apart portions of the armature core when in the second axial position to complete an electrical circuit between the pair of spring arms so that the control switch is in a closed position. The inner ends of the spring arms are in sliding engagement with the armature core and are moved out of engagement with the armature core when the armature core is moved to the first axial position so that the control switch is in an open position. The sliding contact of the inner ends of the spring arms with the armature core performs a wiping action on the armature core to provide a self-cleaning action when the armature core is moved between the two axial positions.

BRIEF DESCRIPTION OF THE DRAWINGS

Other objects and advantages will appear as the description proceeds when taken in connection with the accompanying drawings, in which—

DESCRIPTION OF THE PREFERRED EMBODIMENT

Figure 1:
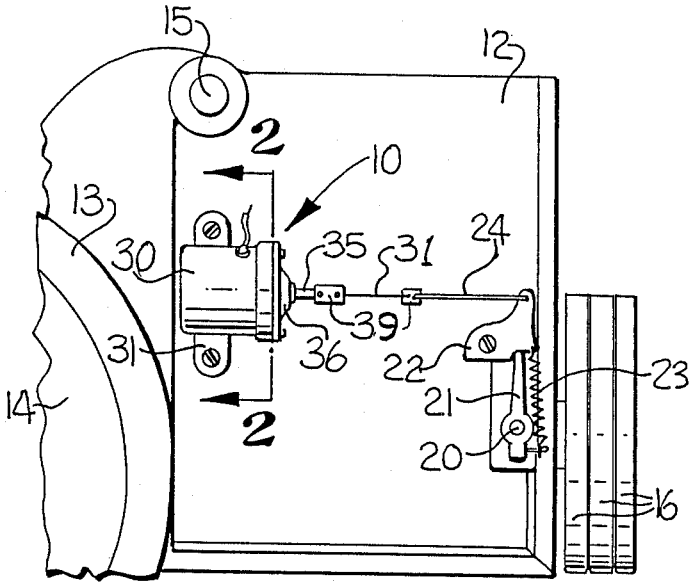
FIG. 1 is a top plan view of a fragmentary portion of a circular knitting machine and showing the activator of the present invention associated therewith.

As shown in FIG. 1, the stop motion activator of the present invention, broadly indicated at 10, is illustrated as being supported on the upper horizontal portion of a circular knitting machine frame 12. The frame 12 also supports a circular bed plate 13 and a circular cam plate 14 surrounding the rotating needle cylinder, not shown. The frame 12 also supports the lower end of the usual vertically extending yarn creel support post 15, on which the usual yarn creel, not shown, is supported. The knitting machine also includes conventional drive pulleys 16 which are driven in the usual manner by a belt, not shown. The belt is shifted between the pulleys 16 to drive the knitting machine at a fast speed, a slow speed, or discontinue driving motion of the knitting machine when shifted onto an idler pulley.

The conventional stop motion of the knitting machine is illustrated as including a vertically supported control shaft 20 supported in the machine frame 12 and being operable to shift the drive belt onto the idler pulley and stop operation of the knitting machine. The control shaft 20 may be operable to operate a conventional knock-off lever, not shown, to restrain the driving pulley from rotation and thereby stop the operation of the knitting machine. The upper end of the control shaft 20 has one end of a trip lever 21 fixed thereto. The rear free end of the trip lever 21 is illustrated as being restrained against rotation by a step on a pivoted trigger lever 22. The free end of the trip lever 21 is resiliently maintained in engagement with the trigger lever 22 by a tension spring 23, extending between the trip lever 21 and the trigger lever 22. A control rod 24 is connected at one end to the trigger lever 22 and its opposite end is operatively connected to the activator 10, in a manner to be presently described.

Figure 4:
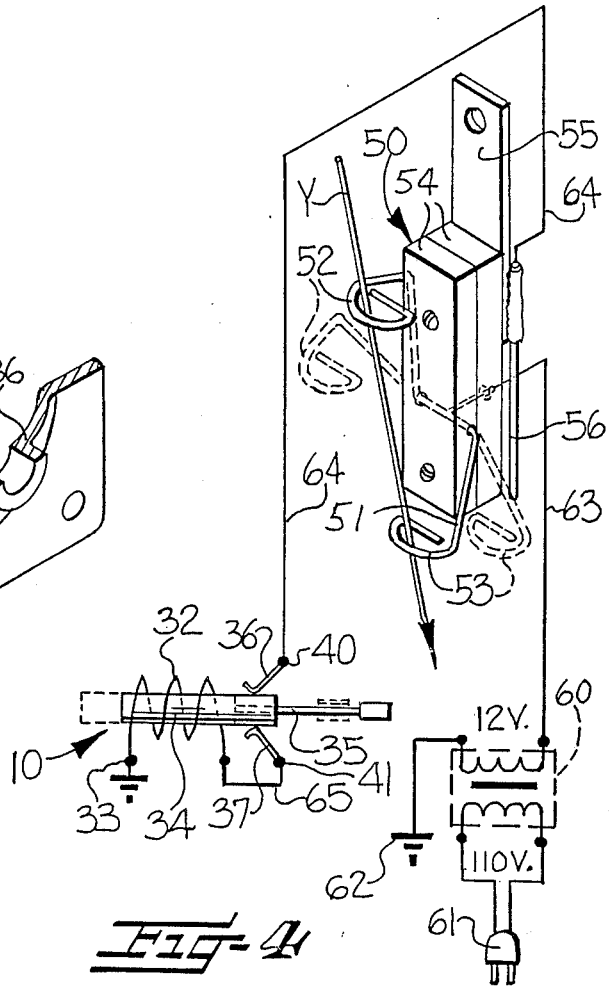
FIG. 4 is a somewhat schematic wiring diagram illustrating the present activator operatively associated with a broken yarn detector.

The activator 10 includes a nonconductive molded plastic housing 30 provided with a grounded mounting bracket 31 for securing the housing 30 to the upper platform of the machine frame 12 (FIG. 1). A solenoid coil 32 is supported within the housing 30 and is grounded to the machine frame 12, as indicated at 33 (FIG. 4). An electrically conductive elongate armature core 34 is supported for axial movement within the solenoid coil 32 and is provided with an outwardly or forwardly extending stem 35 which has a diameter that is smaller than the diameter of the main body of the armature core 34. The stem 35 extends through an opening in a cover plate 36 which is fixed to the square flange on the forward end of the housing 30 (FIG. 1). A cable 31 is connected between the forward end of the stem 35 and the free end of the control link 24 by suitable connector collars 39. The armature core 34 is moved inwardly to a first axial position within the solenoid coil 32, as illustrated in dotted lines in FIG. 4, when the solenoid coil 32 is energized, in a manner to be presently described. The armature core 34 is manually movable outwardly to a second axial position, as shown in solid lines in FIG. 4, when the solenoid coil 32 is deenergized.

Figure 2:
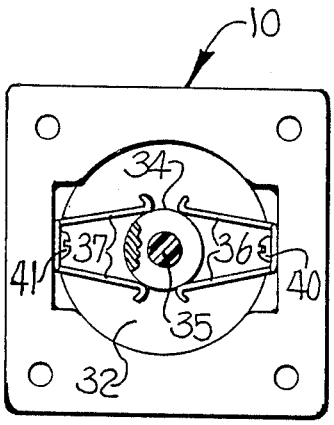
FIG. 2 is an enlarged vertical sectional view of the activator, taken substantially along the line 2—2 in FIG. 1.
Figure 3:
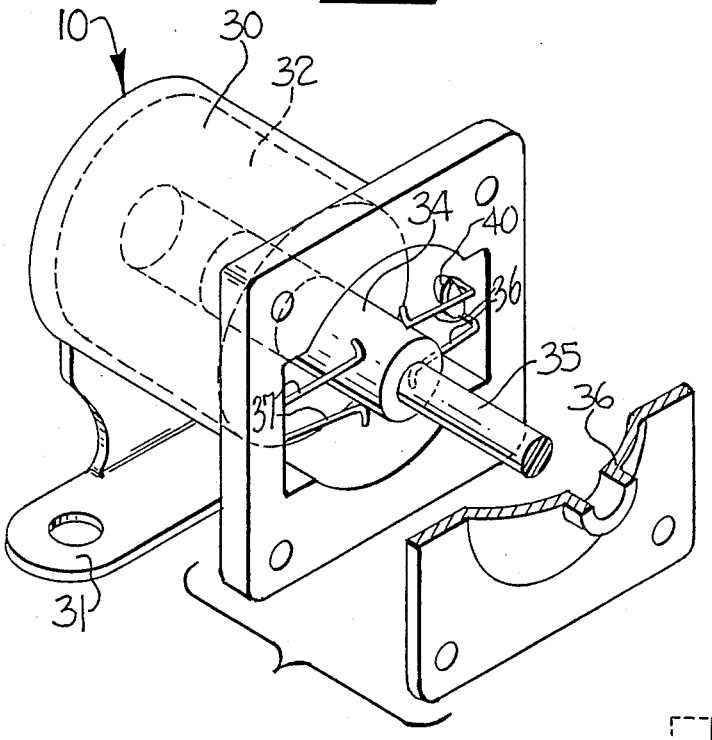
FIG. 3 is an isometric view of one end portion of the activator with the cover plate removed and broken away.

Control switch means is associated with the armature core 34 and is operable between open and closed positions by axial movement thereof. The control switch means includes a pair of electrical spring arm contacts 36, 37 supported in a fixed position at their outer ends on the housing 30 and having their inner ends in electrical contact with spaced-apart portions of the armature core 34 when the armature core 34 is moved outwardly or forwardly, as illustrated in FIGS. 2–4. Thus, the control switch means, formed by the armature core 34 and the spring arms 36, 37, is in a closed position when the armature core 34 is manually moved outwardly or forwardly to the second axial position so that the inner ends of the spring arm contacts are in engagement therewith.

The spring arm contacts 36, 37 are each illustrated as being formed of a single piece of spring wire with an outer U-shaped mounting portion held in contact and in position on the inner portion of the housing 30 by respective mounting screws 40, 41 (FIG. 2). The opposite legs of each of the spring arm contacts 36, 37 extend inwardly, diverging slightly away from each other and their inner ends are bent rearwardly and extend slightly outwardly away from the armature core 34 to provide a type of a cam surface so that the inner ends of the spring arm contacts 36, 37 remain in firm resilient engagement with the outer surface of the armature core 34, when the armature core 34 is manually moved from the first axial dotted line position shown in FIG. 4 to the second axial solid line position shown in FIG. 4.

The knitting machine may be provided with any suitable type of detector switch means normally positioned in a first open position and being movable to a second closed position when a malfunction of the knitting machine occurs. The detector switch means may be provided for detecting various malfunctions of the knitting machine, such as improperly positioned latches on the knitting needles, broken yarns, broken needle butts, improperly positioned yarn feed fingers, or the like. The detector switch, broadly indicated at 50 in FIG. 4, is of the type which is used to indicate a broken yarn Y or a yarn which is under less than the desired running tension. The particular detector switch 50 is illustrated as being of the type disclosed in my U.S. Pat. No. 4,551,591. The detector switch 50 includes a rocker arm 51 which is formed of wire and bent to form an upper eye 52 and a lower yarn eye 53, through which the yarn Y passes from the yarn supply source, not shown, to the feed finger of the knitting machine, not shown. The medial horizontal portion of the rocker arm 51 is supported for pivotal movement in insulated blocks 54, which are in turn mounted on a mounting plate 55 for supporting the detector 50 on the yarn creel of the knitting machine.

A contact wire 56 extends downwardly adjacent the mounting block 54 and is positioned in the path of travel of the rocker arm 51 when the yarn breaks or when the yarn is under insufficient tension to support the rocker arm 51 in the solid line position shown in FIG. 4. Should the yarn break or the tension in the yarn become insufficient, the rocker arm 51 will rotate in a counterclockwise direction, to the dotted line position in FIG. 4, so that the lower arm moves into contact with the wire 56 to close the normally open switch formed by the rocker arm 51 and the wire 56. A step down transformer 60 (FIG. 4) is connected at one side to a suitable source of electrical energy, as indicated by the electrical plug 61. One side of the output side of the transformer 60 is connected to ground, as indicated at 62, and the other side is connected by an electric wire 63 to the rocker arm 51 of the detector switch 50. The wire 56 of the detector 50 is connected to the spring arm contact 36 by a wire 64. The spring arm contact 37 is connected to the solenoid coil by a wire 65.

In normal operation of the knitting machine, the armature core 34 and the stem 35 are manually moved outwardly to the solid line second axial position shown in FIG. 4 so that the stem 35 is operatively connected to the trigger lever 22, when the trip arm 21 is in the normal latched and operating position shown in FIG. 1. In this normal operating position, the control switch, formed by spring arm contacts 36, 37 and armature core 34, is closed. However, no electrical energy is being supplied to the solenoid coil 32 because the detector switch 50 is in the open position while the yarn Y is supporting the rocker arm 51 out of engagement with the contact wire 56, as shown in FIG. 4.

When the yarn Y breaks or becomes excessively slack, the rocker arm 51 of the detector switch 50 moves in a counterclockwise direction so that the rocker arm contacts the contact wire 56 to close the switch and thereby permit the electrical energy to flow from the transformer 60, through wires 63, 64, through the spring arm 36, the armature core 34, the spring arm 37, electrical wire 65, solenoid coil 32, and to the ground 33. This completes the electrical circuit to the solenoid coil 32 and energizes the same so that the armature core 34 is immediately drawn inwardly to the first axial position, shown in dotted lines in FIG. 4. As the armature core 34 is drawn inwardly, the core 34 moves out of contact with the inner ends of the spring arm contacts 36, 37 and immediately breaks the electrical circuit to the solenoid coil 32 to again deactivate the same.

Thus, the solenoid coil 32 is energized only momentarily when a malfunction of the knitting machine is detected by the detector switch 50 so that the machine is immediately stopped as the trigger lever 22 is pivoted in a counterclockwise direction to release the trigger arm 21 and activate the stop motion of the knitting machine. To again start the knitting machine, the broken yarn Y will be rethreaded through the eyes 52, 53 of the rocker arm 51 to again position the rocker arm 51 in the solid line position shown in FIG. 4 so that the detector switch 50 is in an open condition. Then, the armature core 34 is manually moved outwardly to the second axial position, shown in solid lines in FIG. 4, as the trigger lever 22 is moved in a clockwise direction to reset the trip arm 21, thereby making electrical contact between the spring arms 36, 37. However, the electrical circuit to the solenoid coil 32 is not completed because the detector switch 50 is in the open position and will remain in this position until the yarn Y is no longer being properly fed to the knitting machine. When this occurs, the detector switch 50 will again move to the closed position to immediately stop the operation of the knitting machine.

As indicated, the inner ends of the spring arms 36, 37 are resiliently maintained in sliding contact with the spaced-apart portions on the outer surface of the armature core 34 when the armature core 34 is in the outer second axial position. The sliding contact of the inner ends of the spring arms 36, 37 with the armature core 34 performs a wiping action on the armature core 34 to provide a self-cleaning action when the armature core 34 is moved back and forth between the first and second axial positions. Also, the rearwardly and outwardly bent inner ends of the spring arms 36, 37 act as cam surfaces when the armature core 34 is manually moved outwardly from the first axial position, shown in dotted lines in FIG. 4, to the second axial position, shown in solid lines in FIG. 4.

Thus, the solenoid coil 32 of the activator 10 of the present invention is maintained in a deactivated or nonenergized condition while the machine is operating properly. Upon the detection of a malfunction of the knitting machine, the activator 10 is momentarily actuated by energizing the solenoid coil 32 for a brief moment while the armature core 34 is being drawn inwardly to break the electrical contact between the spring arm contacts 36, 37 and the armature core 34. Only a small amount of electrical energy is consumed by the activator 10 because the solenoid coil 32 is energized only momentarily when a malfunction is detected. Since the present activator 10 only operates momentarily during each detection of a malfunction, the activator has a very long wear life.

In the drawings and specification there has been set forth the best mode presently contemplated for the practice of the present invention, and although specific terms are employed, they are used in a generic and descriptive sense only and not for purposes of limitation, the scope of the invention being defined in the claims.

That which is claimed is:

1. In a knitting machine for forming knit fabric including detector switch means normally positioned in an open position and being movable to a closed position when a malfunction of the knitting machine occurs, and stop motion means operable to stop operation of the knitting machine upon detection of a malfunction, the combination therewith of activator means operable by movement of said detector switch means to said closed position to operate said stop motion means, said activator means comprising a solenoid coil, a source of electrical energy, a wiring circuit connecting said source of electrical energy to said solenoid coil and through said detector switch means, an elongate armature core supported for axial movement within said solenoid coil, said armature core being moved to a first position within said solenoid coil when said solenoid coil is energized, and said armature core being manually movable to a second position when said solenoid coil is deenergized, connector means operatively connecting said armature core with said stop motion means for stopping said knitting machine upon movement of said armature core to said first position, and control switch means interposed in said wiring circuit between said detector switch means and said solenoid coil, said control switch means being operatively associated with said armature core and being moved to a closed position when said armature core is in said second position, and to an open position when said armature core is in said first position so that said solenoid coil is energized when said detector switch means is moved to said closed position and deenergized as soon as said armature core is moved to said first position.

2. In a knitting machine according to claim 1 wherein said elongate armature core is round in cross section and includes an operating shaft of reduced diameter extending outwardly therefrom, and wherein said connector means is connected at one end to said operating shaft and at its other end to said stop motion means.

3. In a knitting machine according to claim 2 wherein said armature core is formed of electrically conductive material, wherein said control switch means includes a pair of electrical spring arms having inner ends in electrical contact with spaced-apart portions of said armature core when in said second position to complete an electrical circuit between said pair of electrical spring arms, and wherein the electrical circuit between said pair of electrical spring arms is broken when said armature core is moved to said first position.

4. In a knitting machine according to claim 3 wherein each of said electrical spring arms includes a pair of wire legs each having bent inner end portions forming cam surfaces engaging said armature core, and wherein said cam surfaces are engaged by said armature core when manually moved from said second position to said first position.

5. In a knitting machine according to claim 4 including an electrically nonconductive housing supporting said solenoid coil therein, wherein said pair of wire legs of each of said electrical spring arms have integrally joined U-shaped outer end portions, and including means securing said U-shaped outer end portions to said housing so that the inner end portions of said pair of wire legs are resiliently maintained in contact with the spaced-apart portions of said armature core.

6. In a knitting machine for forming knit fabric including detector means normally positioned in a first position and being movable to a second position when a malfunction of the knitting machine occurs, and stop motion means for stopping operation of the knitting machine upon detection of a malfunction and upon movement of said detector means to said second position, the combination therewith of activator means operable by movement of said detector means to said second position to operate said stop motion means, said activator means comprising a housing supported on said knitting machine, a solenoid coil supported within said housing, a source of electrical energy connected to said solenoid coil, an elongate armature core supported for axial movement within said solenoid coil, said armature core being moved inwardly to a first position within said solenoid coil when said solenoid coil is energized, and said armature core being manually movable outwardly to a second position when said solenoid coil is deenergized, a pair of electrical spring arm contacts supported adjacent said armature core and being movable between a closed position when said armature core is moved outwardly, and to an open position when said armature core is moved inwardly, and connector means operatively connecting said armature core with said stop motion means for stopping said knitting machine upon inward movement of said armature core.

7. In a knitting machine according to claim 6 wherein said armature core is formed of electrically conductive material, and wherein said pair of electrical spring arms have inner end portions in electrical contact with spaced-apart portions of said armature core when moved to said outwardly moved position, and wherein the electrical circuit between said electrical spring arms is broken when said armature core is moved inwardly.

* * * * *